US005162183A

United States Patent [19]

Lindblad et al.

[11] Patent Number: 5,162,183

[45] Date of Patent: Nov. 10, 1992

[54] OVERCOAT FOR IMAGING MEMBERS

[75] Inventors: Nero R. Lindblad, Ontario; Richard L. Schank, Pittsford; Richard W. Bigelow, Webster; Herbert C. Relyea, Webster; Robert E. Trott, Webster; Andrew R. Melnyk, Rochester; Merlin E. Scharfe, Penfield; Walter F. Leising, Webster, all of N.Y.

[73] Assignee: Xerox Corporation, Stamford, Conn.

[21] Appl. No.: 698,215

[22] Filed: May 10, 1991

Related U.S. Application Data

[63] Continuation-in-part of Ser. No. 560,876, Jul. 31, 1990, abandoned.

[51] Int. Cl.[5] ..... G03G 5/047; G03G 5/147

[52] U.S. Cl. ..... 430/59; 430/58; 430/66; 430/67; 430/132; 430/125

[58] Field of Search ..... 430/58, 59, 66, 67, 430/132

[56] References Cited

U.S. PATENT DOCUMENTS

| | | | |
|---|---|---|---|
| 3,121,006 | 2/1964 | Middleton et al. | 430/84 |
| 3,357,989 | 12/1967 | Byrne et al. | 430/78 |
| 3,442,781 | 5/1969 | Weinberger | 430/37 |
| 3,685,907 | 8/1972 | Sato et al. | 430/97 X |
| 3,973,958 | 8/1976 | Bean | 430/66 X |
| 3,992,091 | 11/1976 | Fisher | 427/76 |
| 4,076,564 | 2/1978 | Fisher | 156/664 |
| 4,134,762 | 1/1979 | Metcalfe et al. | 430/87 |
| 4,134,763 | 1/1979 | Fujimura et al. | 427/299 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,415,639 | 11/1983 | Horgan | 430/58 X |
| 4,469,771 | 9/1984 | Hasegawa et al. | 430/58 X |
| 4,571,371 | 2/1986 | Yashiki | 430/60 X |
| 4,587,189 | 5/1986 | Hor et al. | 430/59 |
| 4,588,666 | 5/1986 | Stolka et al. | 430/59 |
| 4,615,963 | 10/1986 | Matsumoto et al. | 430/56 |
| 4,693,951 | 9/1987 | Takasu et al. | 430/56 X |
| 4,764,448 | 8/1988 | Yoshitomi et al. | 430/120 |
| 4,804,607 | 2/1989 | Atsumi | 430/67 |
| 4,904,557 | 2/1990 | Kubo | 430/58 X |
| 4,912,000 | 3/1990 | Kumakura et al. | 430/67 |
| 4,948,690 | 8/1990 | Hisamura et al. | 430/58 X |
| 4,952,473 | 8/1990 | Suzuki | 430/66 X |
| 5,008,706 | 4/1991 | Ohmori et al. | 355/222 X |
| 5,068,762 | 11/1991 | Yoshihara | 430/59 X |

FOREIGN PATENT DOCUMENTS

| | | | |
|---|---|---|---|
| 53-92133 | 12/1978 | Japan | 430/66 |
| 57-74744 | 5/1982 | Japan . | |
| 2-108063 | 4/1990 | Japan . | |

OTHER PUBLICATIONS

M. G. Velarde et al., "Convection", Scientific American, vol. 234, No. 92, 1980, N.Y., pp. 79–93.

Grant & Hackh's Chemical Dictionary, 5th Ed. (1987), pp. 89 and 607.

*Primary Examiner*—Roland Martin

*Attorney, Agent, or Firm*—Oliff & Berridge

[57] ABSTRACT

A surface layer on an imaging member has a surface roughness which reduces the force necessary for blade cleaning, reduces blade edge truck, reduces blade/substrate friction, inhibits the formation of toner-type deposits on the imaging surface, and/or reduces or eliminates light interference patterns resulting from coherent light, for example, from a raster output scanner.

29 Claims, 5 Drawing Sheets

OVERCOAT FOR IMAGING MEMBERS

This is a continuation-in-part application of application Ser. No. 07/560,876, filed Jul. 31, 1990, now abandoned.

BACKGROUND OF THE INVENTION

This invention relates in general to electrophotography, and in particular, to an electrophotographic imaging member having an overcoating layer.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles (toner) on the surface of the photoconductive insulating layer. The resulting visible image may then be transferred from the electrophotographic plate to a support such as paper. This imaging process may be repeated many times with reusable photoconductive insulating layers.

In the imaging process, it is necessary to clean residual toner from the surface of the photoconductive insulating layer prior to repeating another imaging cycle. One common method of cleaning is blade cleaning.

Elastomer blade cleaning of photoreceptors is conceptually simple and economical, but raises reliability concerns in mid- and high-volume applications due to apparent random failures. Such random failures justify the reluctance to include blade cleaners in higher volume machines with or without some back-up element.

Alternative cleaning techniques used in higher volume applications include the use of magnetic, insulative and electrostatic brushes. However, such cleaning techniques are also subject to specific or timed failures. These failures include, but are not limited to, photoreceptor filming and cometing. Specific failures may, in part, be related to the materials package, e.g., the toner and any additives contained with the toner. These types of blade and cleaning failures can be quite predictable One random failure mode of a cleaning blade may be due to inherent variations or flaws in the material of the blade, which allow stresses and strains with extended copying to locally fatigue the edge of the blade. An additional random failure mode can be local or image related enhancements or reductions in blade/-photoreceptor friction which cause unacceptably large tuck-under of a doctor blade edge. A large enough tuck or break in the blade/photoreceptor seal can permit residual toner and other debris to pass under the blade. This not only decreases cleaning efficiency, for example by increasing background, but in severe cases can result in catastrophic system failure.

A number of methods have been implemented or proposed to enhance blade/photoreceptor contact properties. One method includes agitation of the blade against the photoreceptor to prevent build-up of material along the contact seal. Another method includes addition of redundant members, such as disturber brushes to loosen or collect debris which might otherwise stress the blade element. These methods increase the mechanical complexity and the cost of the cleaning assembly, and are thus undesirable.

Another method for enhancing blade/photoreceptor contact properties includes the addition of lubricants to the toner, photoreceptor and/or blade. However, this method increases the materials complexity and introduces compatibility problems.

A further proposal for enhancing blade/photoreceptor contact properties is by roughening of the photoreceptor surface to reduce the blade/photoreceptor contact area, and thus the blade friction. This method may also introduce compatibility problems depending on how the roughened surface is introduced. For example, particulate additives to the bulk of the transport layer can degrade electrical and/or mechanical properties. Surface asperities can be worn away in normal machine copying, limiting any cleaning benefit. Surface roughening can also have direct adverse effects such as the introduction of sites against which toner may become lodged. Photoreceptor surface roughening can also inhibit cleaning by allowing the blade to pass over toner and other surface debris.

U.S. Pat. No. 4,647,521 to Oguchi et al discloses the addition of amorphous hydrophobic silica powder to the top layer of a photosensitive member. The silica is of spherical shape and has a size distribution between 10 and 1000 Angstroms.

U.S. Pat. No. 4,784,928 to Kan et al discloses an electrophotographic element having two charge transport layers. An outermost charge transport layer or overcoating may comprise a waxy spreadable solid, stearates, polyolefin waxes, and fluorocarbon polymers.

One of the most common "predictable" or non-random blade cleaning failures is photoreceptor cometing. This type of failure is generally encountered and resolved during program development. Photoreceptor cometing involves material, including toner particles, which becomes impacted onto the photoreceptor and adheres with such force that the material cannot be removed by the cleaning elements. Additional debris, including untransferred toner residue and developer and/or toner additives, may become jammed against the asperity. Repeated passes and extended copy can lead to the build-up of elongated crusty deposits in front of the asperity which eventually print out as spots on the copy, i.e., the comets.

Various strategies have also been implemented or proposed to deal with this type of blade cleaning problem, including those enumerated above. Additional approaches to the resolution of cometing problems include the elimination of the material which impacts or builds up in the tail, the inclusion of additives which lubricate and/or scavenge the offending material, and the development of a photoreceptor surface which resists toner impaction and/or cometing.

The prevailing opinion as to the origin of comets in blade systems is that localized tucks in the cleaning edge allow the toner particles or comet heads to be compressed into the photoreceptor. Thus, cometing and the more random type of blade cleaning failures may be related.

In some electrophotographic imaging systems, a raster output scanner has been employed to create images on the photoreceptor. Raster output scanners create or write images in accordance with the image content of an image signal. Typical raster output scanner systems include xerographic based systems where the images are written on a photoreceptor. In such devices, the moving photoreceptor, which has been previously charged, is exposed line to line by a high intensity beam of electromagnetic radiation, such as a laser, that has been modulated in accordance with an input signal. The modulated beam is focused by suitable optical elements to a point on the photoreceptor by a scanning element such as a rotating multi-faceted polygon. As a result, latent electrostatic images representative of the input image signal are created on the photoreceptor and are thereafter developed by the application of a suitable toner thereto. The developed images are then transferred to copy sheets and fixed to provide permanent copies.

Some problems, however, are associated with the use of a raster output scanner. Coherent light of a wavelength of about 6500 Ångstroms to about 8500 Ångstroms, when internally reflected between the top and some bottom surface of the imaging member, produces an interference pattern in light absorbed by the photoreceptor. The bottom internal surface usually is a conducting metal ground plane, but may also be an interface at the charge generation layer, the charge transport layer, or other layers in the photoreceptor. The variation in absorption results in a variation in photodischarge, which may print out as an objectionable pattern in a xerographic printer, particularly under conditions of partial discharge. The resulting pattern resembles grain in wood laminates, and is accordingly referred to as plywood.

It is known that the interference pattern may be eliminated by diffuse reflection, for example by roughening the surface of the internal reflective layer. For example, roughened metal substrates may be used. However, roughening of an evaporated metal layer is difficult.

U.S. Pat. No. 4,904,557 to Kubo discloses that dispersions of finely divided inert particles within the photoreceptor can cause sufficient light scattering to eliminate plywood. As indicated above, and also in U.S. Pat. No. 4,904,557, such additives can degrade electrical and/or mechanical properties of the imaging member. This patent also suggests that interference fringe patterns can be avoided by surface roughening achieved by controlling spraying conditions or by grinding. This surface roughness is represented by an average roughness RZ of ten points over a reference length of 2.5 mm, and is equal to or larger than ½ of the wavelength of the light source employed for image formation.

Overcoating layers for electrophotographic imaging members have been proposed for a number of differing reasons. U.S. Pat. No. 4,912,000 to Kumakura et al discloses a protective layer for an electrophotographic photoreceptor. The protective layer comprises a product of uncatalyzed hydrolysis of a composition essentially consisting of at least one specific epoxy silane compound, at least one specific alkyl alkoxy silane compound, and at least one specific amino silane compound. The protective layer protects the photoreceptor from wear due to friction with paper and cleaning members.

U.S. Pat. No. 4,469,771 to Hasegawa et al discloses an electrophotographic light-sensitive member having a protective coating. The protective coating consists of an organic high polymer-containing Lewis acid.

U.S. Pat. No. 4,587,189 to Hor et al and U.S. Pat. No. 4,588,666 to Stolka et al disclose multilayer photoconductive imaging members. The imaging members are provided with an exposed hole transport layer comprised of aryl amine compounds. The '666 patent to Stolka discloses a hole transporting molecule comprised of alkoxy derivatives of tetra phenyl biphenyl diamine.

U.S. Pat. No. 4,615,963 to Matsumoto et al discloses an electrophotographic imaging member having a photosensitive layer which is applied as a paste-like mixture, dispersion, or solution, and quenched to a frozen state under high vacuum under which drying is performed. The drying method is provided so as to avoid formation of coarse particles in the photoconductive composition.

U.S. Pat. No. 4,537,849 to Arai discloses a photosensitive element having a roughened selenium-arsenic alloy surface. The outer photoconductive surface is roughened by direct mechanical grinding (polishing). A roughness of less than or equal to 3.0 micrometers laterally and from 0.1 to 2.0 micrometers in height is disclosed for reducing adhesion of transfer paper or toner.

U.S. Pat. Nos. 3,992,001 and 4,076,564 to Fisher disclose roughened imaging surfaces of a xerographic imaging member. Roughening of the photoreceptor surface is accomplished indirectly by first chemically etching a substrate. The substrate is then uniformly coated with photoconductive material which conforms to the surface in such a way that the substrate roughness is reproduced on the photoconductive surface. The level of roughness may be from 3 to 5 micrometers laterally with a 1 to 2 micrometers height or from 10 to 20 micrometers laterally with a 1 to 2 micrometers height.

The Kodak ColorEdge (TM) photoreceptor (introduced in 1988) is provided with a highly and specifically textured surface. The texturing is obtained by placing a "dot screen" on internal layers of the photoreceptor followed by overcoating with a charge transport layer. The final surface conforms closely to the dimensions of the "internal" asperities. The photoreceptor is cleaned by a fur brush cleaner and thus the roughened surface is not believed to be engineered to assist cleaning.

U.S. Pat. No. 4,904,557 to Kubo discloses an electrophotographic photosensitive member comprising a photosensitive layer having a surface roughness of ten points over a reference length of 2.5 millimeters. The particular surface roughness is provided to prevent an interference pattern appearing at image formation, and for preventing black dots appearing at reversal development.

U.S. Pat. No. 4,693,591 to Takasu et al discloses an image bearing member having a maximum surface roughness of 20 micrometers or less, and an average surface roughness which is less than or equal to two times a toner particle size. Takasu et al have a limitation on the amplitude of the roughness, but do not disclose the particular wavelength between peaks.

U.S. Pat. No. 4,804,607 to Atsumi discloses an overcoat layer which is a film-shaped inorganic material coating the surface of a photosensitive layer. The overcoat layer is formed such that the rough surface is provided having convexities and concavities with a maximum depth difference of 0.5 to 1.5 micrometers. The convexities and concavities are formed by vacuum evaporating the overcoat layer onto the photosensitive layer, and heating the support, photosensitive layer and the overcoat layer to form wrinkled-shaped convexities and concavities.

SUMMARY OF THE INVENTION

It is an object of the invention to reduce wear and increase durability of exposed layers in a photosensitive device.

It is also an object of the invention to reduce frictional contact between contacting members in an imaging device.

It is also an object of the invention to provide an overcoating layer which prevents the formation of comets.

It is a further object of the invention to prevent particles on a photosensitive layer from becoming impacted.

It is also an object of the invention to reduce cleaning blade edge tuck on a surface of an imaging member.

It is an object of the invention to provide a process for preparing an overcoating layer having a roughness which reduces the force necessary for blade cleaning, reduces blade edge tuck, and reduces blade/substrate friction.

It is an object of the invention to eliminate plywood patterns in electrophotographic imaging processes.

It is another object of the invention to provide an electrophotographic imaging member having improved wear resistance of the exposed layers which improves the optical and electrical integrities of the layers when used in conjunction with raster output scanners.

These and other objects of the invention are achieved by providing an overcoating layer for an electrophotographic imaging member having a particular surface roughness, and a process for producing the overcoating layer. In one specific embodiment, the overcoating layer may comprise a charge transport compound dispersed in a film forming binder. The overcoating layer material is chosen so that when applied with a suitable solvent, circulation or evaporation patterns develop during drying. The drying conditions are controlled such that the patterns become frozen in, leaving a roughened surface optimized to enhance cleaning, to reduce the impaction of small particles and toner, and/or to reduce or eliminate plywood patterns. The surface roughness of the overcoat layer reduces the force necessary for cleaning, reduces blade edge tuck, reduces the blade/photoreceptor friction, and/or provides the interface necessary to achieve phase shifts within the internally reflected light and/or its diffuse reflection sufficient to reduce and/or eliminate plywood. The overcoat produces no apparent adverse effects on electrical or mechanical properties, and is resistant to machine erosion.

BRIEF DESCRIPTION OF THE DRAWINGS

A more complete understanding of the present invention may be obtained by reference to the accompanying drawings wherein.

DESCRIPTION OF PREFERRED EMBODIMENTS

Figure 1:
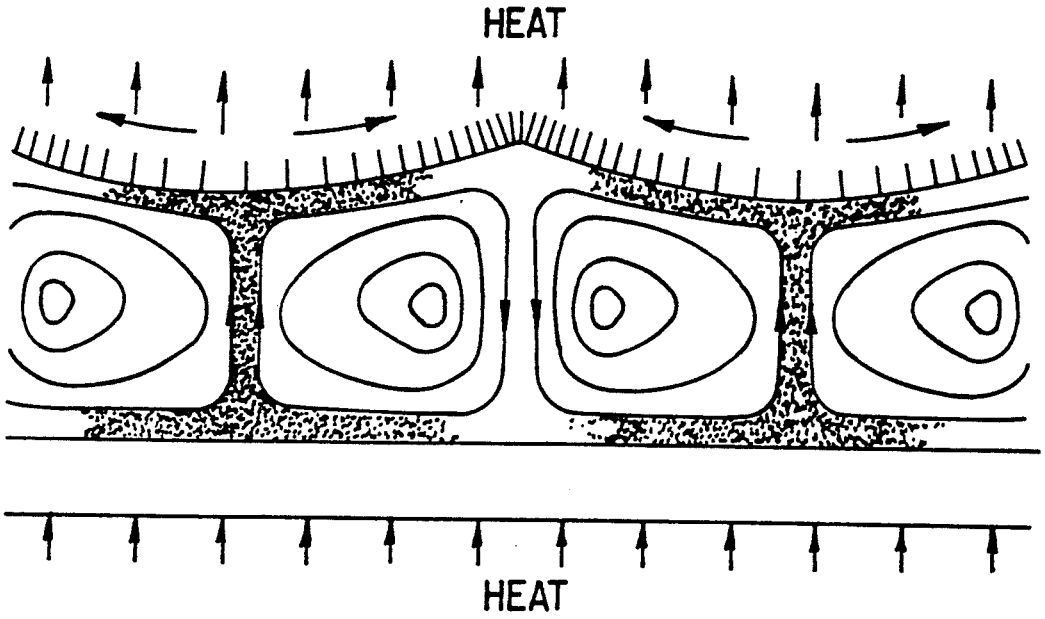
FIG. 1 is a cross section of a Benard convection cell showing directions of fluid flow and temperature gradients.

The overcoat layers of the present invention are provided with one or more levels of surface roughness, which can reduce frictional contact between contacting members such as blades, which can improve wear resistance and increase durability and/or which can eliminate the plywood defect. The surface roughness can reduce the force necessary for blade cleaning, reduce blade edge tuck, reduce blade/substrate friction, and/or eliminate the plywood defect without adversely affecting the optical and electrical integrities of the photosensitive device. Still further, the surface roughness of the invention can prevent particles from becoming impacted and also prevent the formation of comets.

The desired surface roughnesses of the overcoat layer of the invention may be obtained through the selection of material, solvent and drying conditions which develop circulation or evaporation patterns. The patterns become frozen into the surface to form the desired surface roughnesses. The material is preferably a film forming polymer binder/charge transport molecule composite, which when cast from suitable solvents and appropriately dried develops well-defined circulation patterns which become frozen into the photoreceptor surface. The desired roughness may also be formed by coating polymers out of fast evaporating alcohols with a molecular weight lower than butanol, for example, ethanol and methanol, to form a non-continuous overcoat if the average thickness of the overcoat layers is less than a few micrometers. The resulting film contains hemispheric dots or islands, one to two micrometers in diameter and about 0.2 to about 0.5 micrometer in height. The dots appear similar to water droplets on a non-wetting surface and have a concentration of about 10,000 to 40,000 dots per square millimeter. Such islands should be small relative to the resolution of the image, preferably smaller than the toner particles and a few tenths of a micrometer in height.

Overcoat layers for liquid ink development generally need to be typically 5 to 10 times thicker than the above-described non-continuous overcoat. These overcoats can be combined with electron donor moieties, such as described herein for the present applications, which are reacted with a polymer, for example, a nylon type polymer.

Surface asperities of appropriate dimension provided on the photoreceptor surface permit the reduction of blade tuck, the reduction of blade/photoreceptor friction, the prevention of cometing, and/or the reduction or elimination of plywood defects.

The overcoat layer of the invention may be a polymer overcoat layer with a rough textured surface. The overcoat layer preferably is also resistant to machine wear. Preferred polymer materials include silicone hardcoats and nylon polymers. These materials can be made conductive or charge transporting, if desired, by the addition of charge transporting compounds or electron donor compounds.

The overcoat layer of the invention may comprise activating compounds or charge transport molecules dispersed in a film forming binder. The charge transport molecules preferably contain a group or groups which may react with the film forming binder to lock the charge transport molecules in the binder. For example, the charge transport molecules may contain hydroxy groups which react with the film forming polymer through hydrogen bonding. Thus, the charge transport molecules are not drawn out of the overcoat during machine functions, such as occurs with typical charge transport molecules used in a charge transport layer of an electrophotographic imaging member.

The overcoat layer may preferably be formed from a mixture comprising at least one aromatic amine compound (triaryl amine) of the formula:

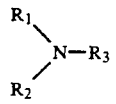

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron-withdrawing groups such as $NO_2$ groups, CN groups, and the like.

A preferred aromatic amine compound has the general formula:

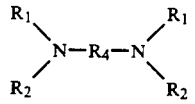

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms.

Examples of charge-transporting aromatic amines represented by the structural formulae above include triphenylmethane, bis(4-diethylamine-2-methylphenyl)-phenylmethane; 4-4'-bis(diethylamino)-2,2'-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3-methylphenyl)-1,1'biphenyl)-4,4'-diamine; and the like, dispersed in an inactive resin binder.

Triaryl amines are well known as charge transporting compounds. A more detailed discussion of the triaryl amines will be made hereinbelow in reference to a charge transport layer of an electrophotographic imaging member. However, to facilitate understanding of the present invention, reference will be made to a specific charge transport molecule used in the overcoat layer of the present invention. The charge transport molecules of the present invention are analogs of triaryl amines. One specific analog of a triaryl amine has the formula:

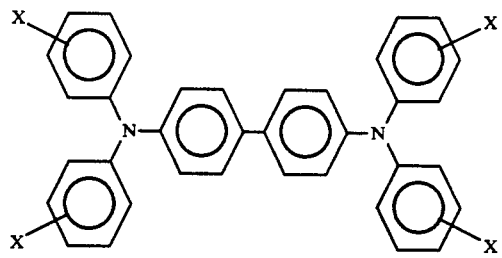

wherein X represents a hydroxy group or hydrogen. Preferred analogs of the above compounds include the dihydroxy analog and the tetrahydroxy analog.

Any suitable "inert" film forming binder may be employed in the overcoat layer. The binder is preferably soluble in a solvent which will not affect the properties of the charge transport layer if the overcoat layer is applied to the charge transport layer. Thus, since the charge transport layer is typically applied with methylene chloride, it is preferred that the overcoat materials be soluble in a solvent such as alcohol which will not attack the charge transport layer. Typical inert film forming binders include polyamides, acrylics, polyurethanes, and the like. Of course, binders which are soluble in methylene chloride may also be used, if desired, and if the requisite circulation patterns can be obtained (when achieving the surface roughness through development of circulation patterns). Typical inert film forming binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

One preferred film forming binder is du Pont's Elvamide 8061 polyamide. It is believed that du Pont Elvamide 8061 is mainly a nylon 6,6 material, containing carboxyl, amide and amine groups. It is softer and more flexible than conventional nylons, but is tough and withstands impact and resists abrasion. Nylons are generally known as being hydrophilic, and as such would be generally unsuitable for photoconductor applications. However, it is believed that hydrogen bonding sites along the nylon backbone are occupied by the hydroxy substituent groups of the charge transport compound of the invention which renders the overcoat hydrophobic. This is evidenced by the charge transport compound being unable to be leached from the overcoat by solvents such as ISOPAR, a highly purified branched chain alkane solvent available from Exxon Corp.

Other preferred polymer materials are silicones, and in particular, silicone hard coats. Silicone materials which may be used in the present invention include silicone-silica hybrid polymers disclosed in U.S. Pat. No. 4,770,963; dispersions of colloidal silica and hydroxylated silsesquixone in alcoholic media disclosed in U.S. Pat. No. 4,565,760; cross-linked siloxanol-colloidal silica hybrid materials disclosed in U.S. Pat. No. 4,439,509; and silicone hard coat materials commercially available from General Electric Corporation as Silicone Hard Coatings; from SDC Coatings, Inc., as Silvue Abrasion Resistant Coatings, formerly sold as Vestar Coatings from Dow Corning; and Owens Illinois-NEG TV Products, Inc., as glass resins. The relevant disclosure of the above patents is hereby incorporated by reference. Silicone hard coat materials are sometimes referred to as crosslinkable siloxane-colloidal silica hybrid materials, being characterized as dispersions of colloidal silica and a partial condensate of a silanol in an alcohol/water media.

The overcoat layer may further contain additives, such as adhesion promoters. For example, adhesion promoters such as polymethyl methacrylate available from du Pont as Elvacite 2008, may be added. Other additives include Elvacite 2044, Elvacite 2046 and Elvacite 2028, all available from du Pont. When these additives are employed, they may be present in the overcoat layer in an amount ranging between about 0.1% and about 15.0%. Alternatively, the adhesion promoter may be applied on the substrate surface (i.e., the charge transport layer) as a separate layer to promote interfacial adhesion. Separate primer layers may be provided to promote adhesion and may be formed from the above Elvacites or may be formed from acrylic emulsion polymers such as those available from National Starch Corp. as Dur-o-cryl 720 and Dur-o-cryl 820. When applied as a separate layer, the adhesion promoter should have a thickness between about 300 Å and about 500 Å.

Any suitable and conventional technique may be utilized to mix and thereafter apply the overcoat mixture. Typical application techniques include spraying, dip coating, roll coating, wire wound rod coating, and the like.

In one embodiment of the invention, rough surface topologies may be obtained by drying the overcoat layer in an open atmosphere in a clean room facility at about 65 to about 70° F. and relative humidity of about 30 to 40%. These conditions yield an enhanced rate of solvent evaporation and the appropriate turbulent drying conditions.

The phrase "turbulent drying conditions" refers to conditions wherein circulation patterns are formed in the overcoat layer while drying. It is believed that selection of the appropriate drying conditions for the particular overcoat layer solvent/solute mixture creates a temperature difference between the top and bottom layers of the coated solution sufficient to induce hydrodynamic instability or convective motion. Features developed within the solution during such fluid motion become implanted or frozen into the dried overcoat surface as the solute is continuously "precipitated" from the evaporating solvents. It is further believed that evaporative cooling is the driving force for convective motion in the overcoat layers of the present invention.

The surface topology of the overcoat layers formed from circulation patterns of the present invention may be rationalized as manifestations of Benard convection. Benard convection refers specifically to a fluid which is open to air. Since the fluid is unconstrained, temperature differences can develop not only through the layer, but across its surface as well. The unconstrained surface permits surface tension gradients to develop which cause texturing of the surface. Additional properties which affect the dynamics include internal viscous drag, and heat diffusion and density variation within the fluid.

Figure 2A:
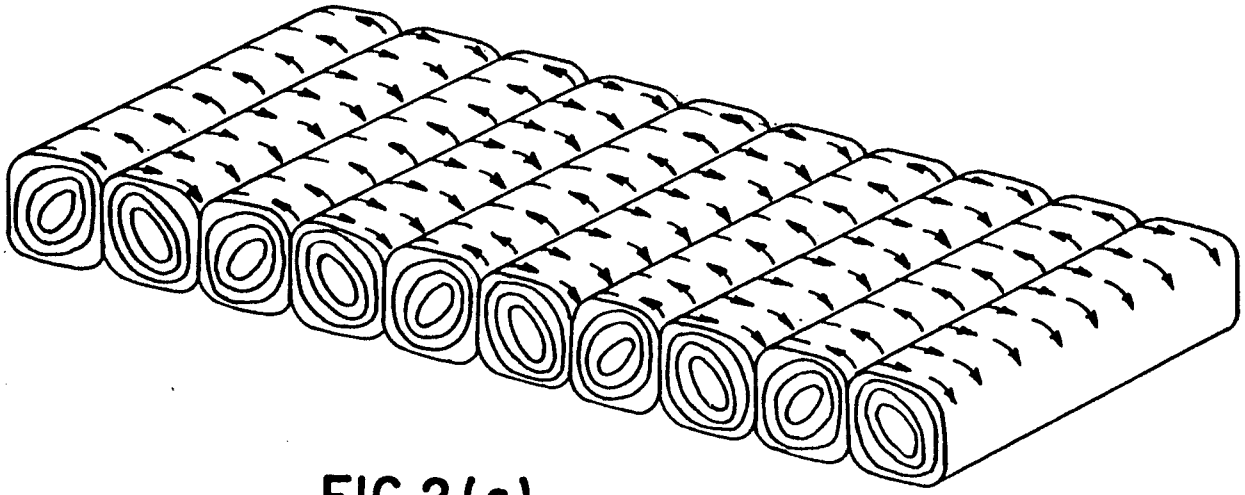
FIGS. 2(*a*) and 2(*b*) are schematic illustrations of circulation patterns which develop during drying of the overcoat layers of the invention.
Figure 2B:
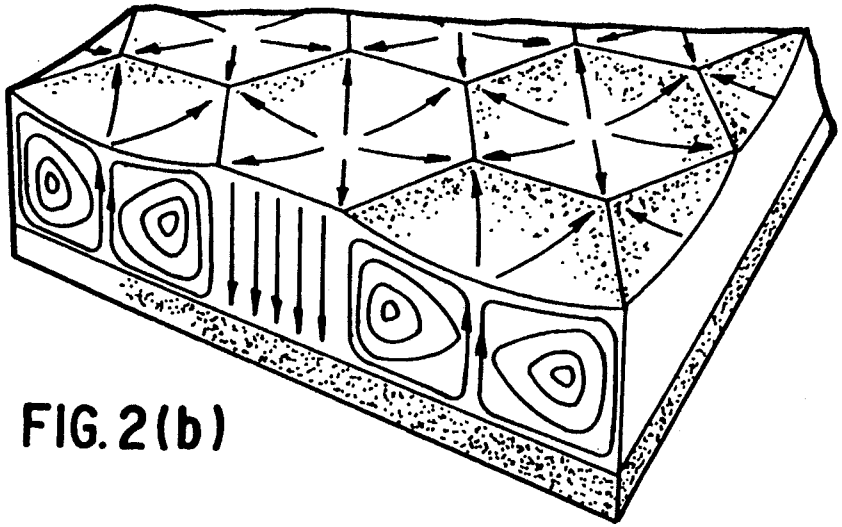

For practical purposes, there are three regimes of solvent/solute activity which may occur in an overcoat layer. In one regime, solvent evaporation occurs below the threshold for hydrodynamic instability. This condition will result in a layer having a smooth surface, provided that particulate additives are not present and/or layer thicknesses do not produce isolated islands, as discussed above. Another regime involves solvent evaporation occurring just above the threshold or at the on-set of hydrodynamic instability. This condition is reflected by random or turbulent drying patterns and will result in a roughened surface desired in an overcoat layer of the invention. The last regime involves solvent evaporation during Benard convection to produce a layer according to the invention. Fully developed Benard convection is characterized by a well defined self-organized convection pattern. FIG. 1 is a cross section of a Benard convection cell, wherein external arrows denote temperature gradients and internal arrows denote the direction of fluid flow. These patterns may be classified into roll-type convection and cell-type convection. Roll-type convection is shown in FIG. 2(*a*) wherein arrows denote the direction of fluid motion. Cell-type convection is shown in FIG. 2(*b*) and results in regular polygons having from 4 to 7 sides formed in the coating surface. Regular hexagons are the most stable configuration.

Velarde and Normand, "Convection", Scientific Amer., 243, 92 (1980), describes surface texturing during Benard convection as having the feature of convection driven by surface-tension gradients that alters the contour of the surface. Regions of enhanced surface tension tend to pucker, so that they reduce their total exposed area. In the center of a Benard cell, where the fluid is rising, the surface is depressed. At the edges of the cell, where the fluid is falling, the surface is raised. On a smaller scale, a considerably complex convective process can be observed in a drying film of paint or lacquer. The driving force is surface tension and not buoyancy. The mechanism ultimately responsible for the flow is the evaporation of solvent from the free surface of the film. If some perturbation increases the rates of evaporation in a region, that region will be cooled, which increases its surface tension. Moreover, the intrinsic surface tension of the pigments or other large molecules in the film is usually greater than the tension of the solvent, so that a deficiency in solvent raises the surface tension independently of the temperature. The liquid is drawn across the surface to regions of elevated surface tension, where it sinks to the base of the film and resumes the cycle. As the concentration of solvent is reduced, however, the viscosity increases, and ultimately the Marangoni number falls below the critical value. Convection then stops.

Velarde and Normand further disclose that convection cells in paint films often have a hexagonal form, or at least a polygonal form that approaches the ideal of regular hexagons. The flow can cause "flooding" of pigments, which is observed in the dry film as an irregularity in coloring. In some cases, the 3-dimensional pattern of the convection cells remains frozen in the dry film. Velarde and Normand note that this phenomena is not always undesirable, i.e., paint with a "hammer" finish acquires its texture by this means.

The surface roughness of the overcoat layer may further be obtained by coating polymers out of fast evaporating alcohols with a molecular weight lower than butanol having an initial or wet thickness of about 10.0 to about 40.0 micrometers. Upon drying, a non-continuous overcoat containing hemispheric dots is formed. Polymers which can be used to obtain a non-continuous overcoat layer include, for example, silicones, and in particular the silicone hard coats described herein. The silicone hard coats, for example, are spray coated out of alcohol and air dried. The overcoated substrate or imaging member is then placed in an air circulating oven and further dried for 30 minutes to 1 hour at 50° C. to about 100° C., depending on the nature of the substrate.

Figure 3:
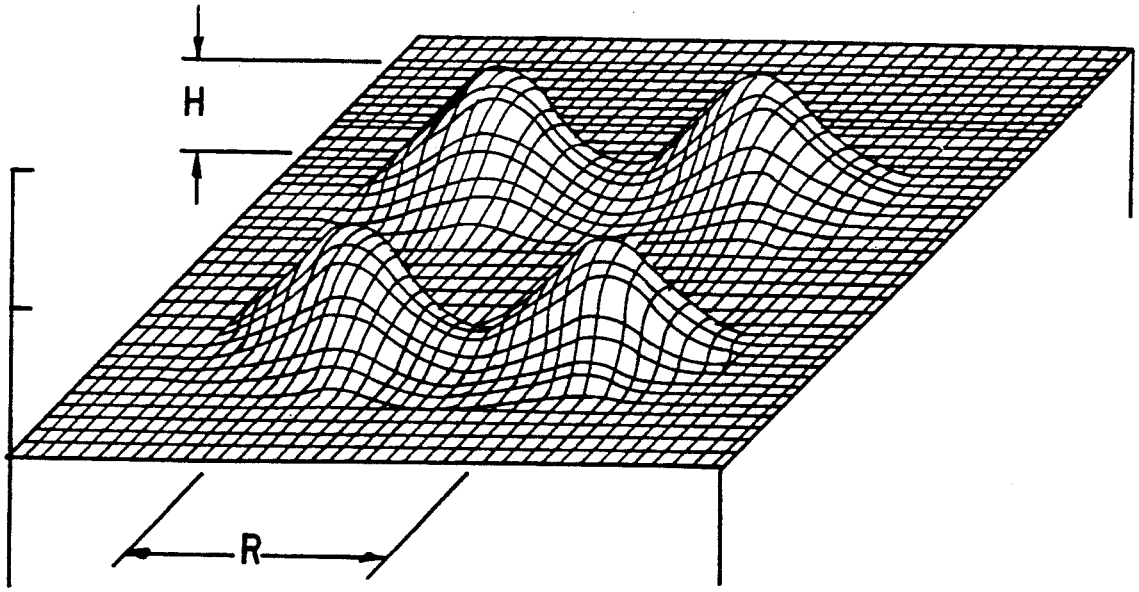
FIG. 3 is a diagram illustrating lateral and vertical roughness.

Referring to FIG. 3, the desired roughness may be described in terms of a lateral roughness R and a vertical roughness, H. Lateral roughness refers to a distance between adjacent peaks on a surface. Vertical roughness refers to the height of a peak to a valley. A "coarse" scale of lateral roughness, R, of the present invention may range from about 10.0 micrometers to about 200.0 micrometers, and more preferably from about 50.0 micrometers to about 150.0 micrometers. A vertical roughness H may range from under about 1.0 micrometer and more preferably ranges from about 0.1 micrometer to about 0.3 micrometer. It has been observed that "finer" scales of roughness may be provided for elimination of plywood or may accompany the coarse roughness scale of the present invention. This "finer" scale of roughness includes a lateral roughness R of about 1–10 micrometers and a vertical roughness H of about 0.2–0.3 micrometer. A surface which reduces or eliminates plywood preferably has a lateral roughness R ranging from about 1.0 micrometer to about 200.0 micrometers, more preferably from about less than or equal to 5.0 micrometers to about 100.0 micrometers, and a vertical roughness H ranging from about 0.1 micrometer to about 1.5 micrometer, more preferably from about 0.2 micrometer to about 0.5 micrometer.

The roughnesses of the overcoat of the invention provide a sloping gradient between asperities. This sloping gradient may further assist in obtaining the advantages of the invention by permitting a cleaning blade to more completely conform to the overcoat layer surface. Surface roughness patterns which are more "rough" cause the applied stress from a blade to be more impulsive. This impulsive action of the blade is caused by the blade rapidly reseating itself, which allows comets to build up or grow when toner material is wedged in front of an asperity. The overcoat layers of the present invention avoid these problems.

The dry continuous overcoat layer of the invention may have a thickness ranging from about 0.5 micrometers to about 10.0 micrometers, and preferably from about 3.0 micrometers to about 5.0 micrometers. Thinner continuous layers, for example less than about 1.0 micrometer to about 2.0 micrometers, do not roughen as much as thicker layers. The overcoat, however, may alternatively be non-continuous as discussed above.

Figure 4:
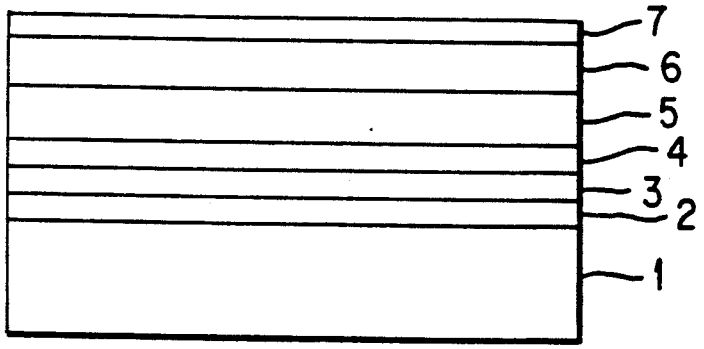
FIG. 4 is a cross-sectional view of a multilayer photoreceptor of the invention with a cleaning blade and a raster output scanner.
Figure 5:
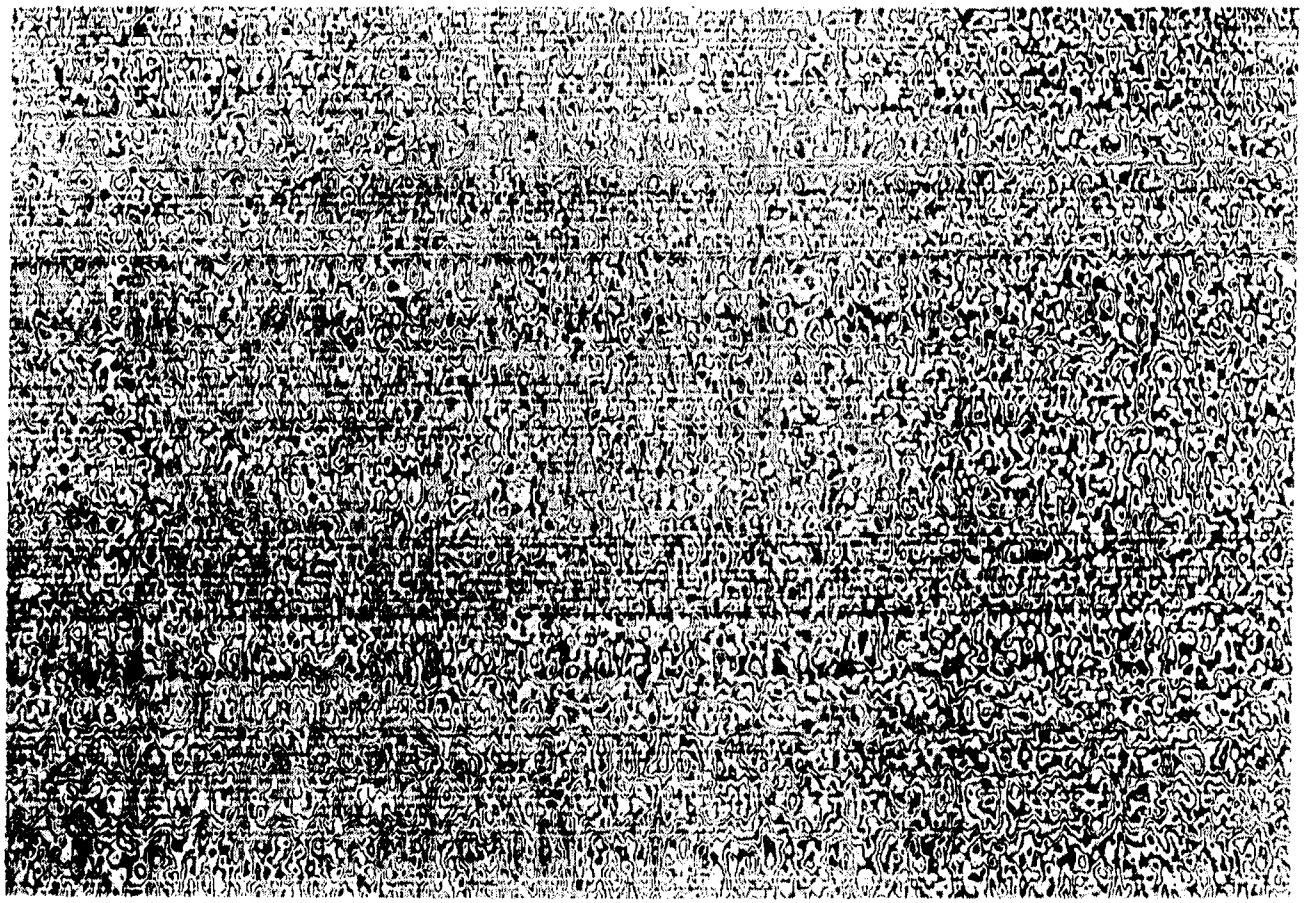
FIG. 5 is a sample print from an uncoated photoreceptor showing plywood print defect.
Figure 6:
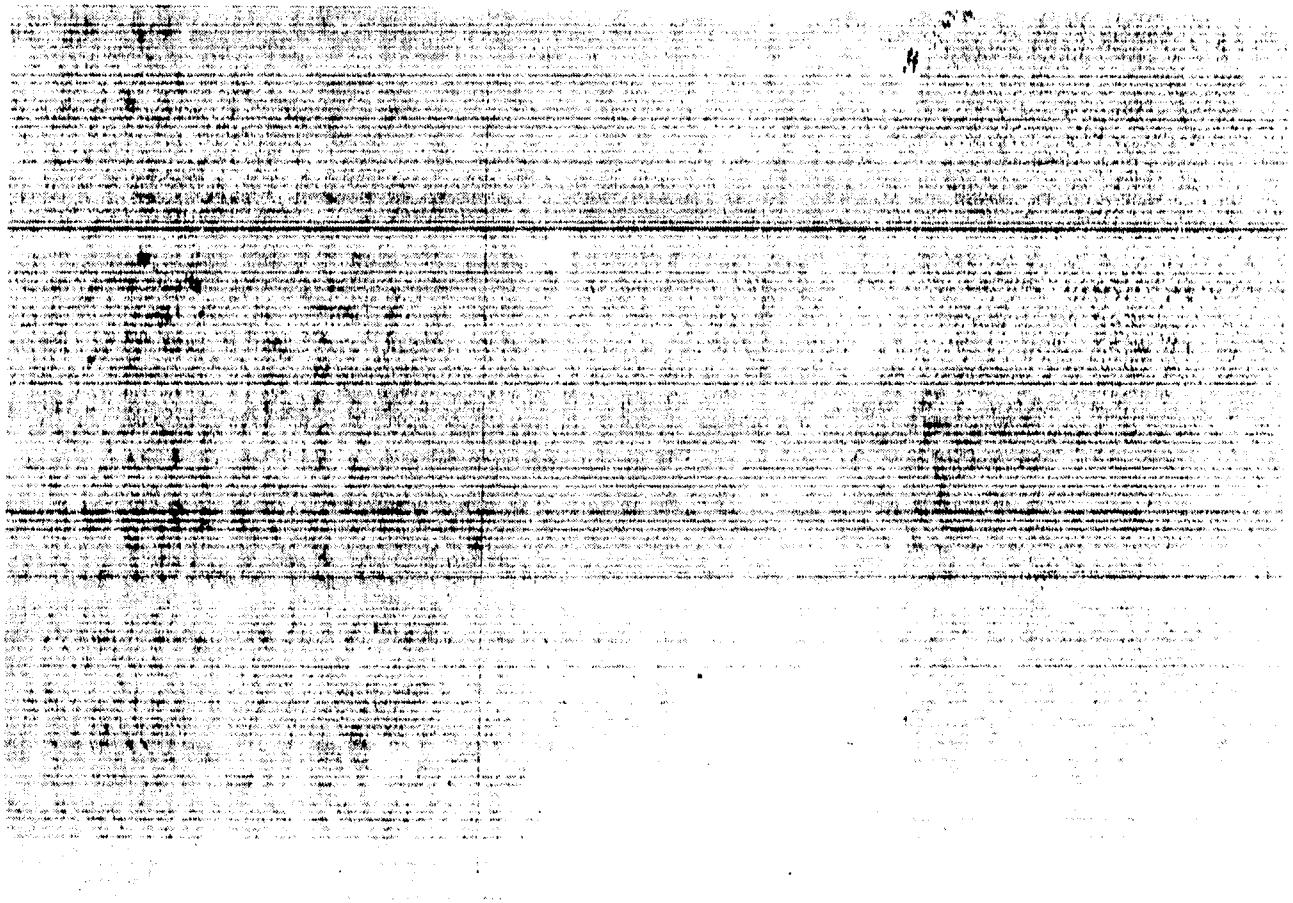
FIG. 6 is a sample print from a coated photoreceptor of the present invention showing no plywood print defect.

The above described overcoat layers may be provided on any of a number of imaging members such as electrophotographic and ionographic imaging members. Such imaging members comprise at least one photosensitive layer. One type of electrophotographic imaging member is a multilayer imaging member as shown in FIG. 4. This imaging member is provided with a supporting substrate 1, an electrically conductive ground plane 2, a hole blocking layer 3, an adhesive layer 4, a charge generating layer 5, and a charge transport layer 6. The overcoat layer of the invention is shown as overcoat layer 7. An optional anticurl layer (not shown) may be provided adjacent the substrate opposite to the imaging layers for preventing curling of the layered imaging member. Cleaning blade 8 and raster output scanner (ROS) 9 are also schematically depicted. A description of the layers of the electrophotographic imaging member shown in FIG. 4 follows.

The supporting substrate 1 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex, available from ICI Americas Inc., or Hostaphan, available from American Hoechst Corporation.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example, less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The electrically conductive ground plane 2 may be an electrically conductive metal layer which may be formed, for example, on the substrate 1 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

After deposition of the electrically conductive ground plane layer, a blocking layer 3 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen-containing siloxanes or nitrogen-containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, $[H_2N(CH_2)_3]CH_3Si(OCH_3)_2$, (gamma-aminopropyl) methyl diethoxysilane, as disclosed in U.S. Pat. Nos. 4,338,387, 4,286,033 and 4,291,110. A preferred hole blocking layer comprises a reaction product between a hydrolyzed silane or mixture of hydrolyzed silanes and the oxidized surface of a metal ground plane layer. The oxidized surface inherently forms on the outer surface of most metal ground layers when exposed to air after deposition. This combination enhances electrical stability at low RH. The hydrolyzed silanes have the general formula:

I

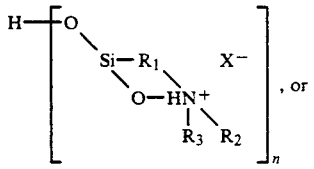

, or

II

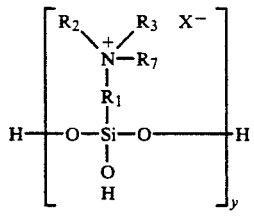

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

In most cases, intermediate layers between the blocking layer and the adjacent charge generating or photogenerating layer may be desired to promote adhesion. For example, the adhesive layer 4 may be employed. If such layers are utilized, they preferably have a dry thickness between about 0.001 micrometer to about 0.2 micrometer. Typical adhesive layers include film-forming polymers such as polyester, du Pont 49,000 resin (available from E.I. du Pont de Nemours & Co.), Vitel PE-100 (available from Goodyear Rubber & Tire Co.), polyvinylbutyral, polyvinylpyrrolidone, polyurethane, polymethyl methacrylate, and the like.

Any suitable charge generating (photogenerating) layer 5 may be applied to the adhesive layer. Examples of materials for photogenerating layers include inorganic photoconductive particles such as amorphous selenium, trigonal selenium, and selenium alloys selected from the group consisting of selenium-tellurium, selenium-tell-urium-arsenic, selenium arsenide; and phthalocyanine pigment such as the X-form of metal-free phthalocyanine described in U.S. Pat. No. 3,357,989; metal phthalocyanines such as vanadyl phthalocyanine and copper phthalocyanine; dibromoanthanthrone; squarylium; quinacridones such as those available from du Pont under the tradename Monastral Red, Monastral Violet and Monastral Red Y; dibromo anthanthrone pigments such as those available under the trade names Vat orange 1 and Vat orange 3; benzimidazole perylene; substituted 2,4-diamino-triazines such as those disclosed in U.S. Pat. No. 3,442,781; polynuclear aromatic quinones such as those available from Allied Chemical Corporation under the tradename Indofast Double Scarlet, Indofast Violet Lake B, Indofast Brilliant Scarlet and Indofast Orange; and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infrared light.

Any suitable polymeric film-forming binder material may be employed as the matrix in the photogenerating layer. Typical polymeric film-forming materials include those described, for example, in U.S. Pat. No. 3,121,006. The binder polymer should adhere well to the adhesive layer, dissolve in a solvent which also dissolves the upper surface of the adhesive layer and be miscible with the material of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected, providing the objectives of the present invention are achieved.

Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The charge transport layer 6 may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is normally transparent in a wavelength region in which the photoconductor is to be used when exposure is effected therethrough to ensure that most of the incident radiation is utilized by the underlying charge generating layer. When used with a transparent substrate, imagewise exposure or erasure may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds or charge transport molecules dispersed in normally electrically inactive film-forming polymeric materials for making these materials electrically active. These charge transport molecules may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge-transporting aromatic amine, and about 75 percent to about 25 percent by weight of a polymeric film-forming resin in which the aromatic amine is soluble.

The charge transport layer is preferably formed from a mixture comprising at least one aromatic amine compound of the formula:

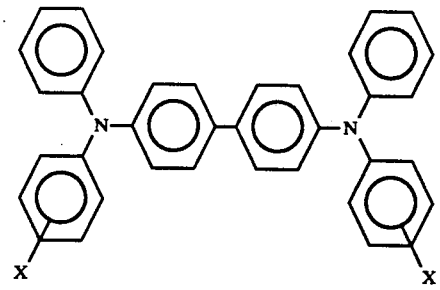

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

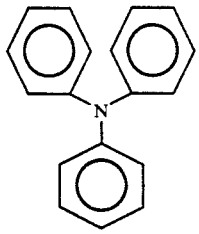

II. Bis and poly triarylamines such as:

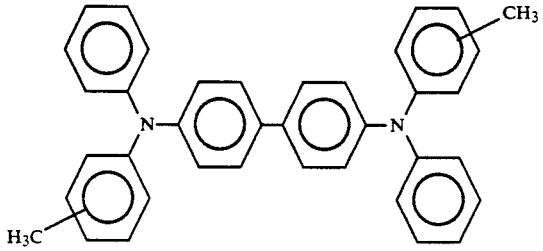

III. Bis arylamine ethers such as:

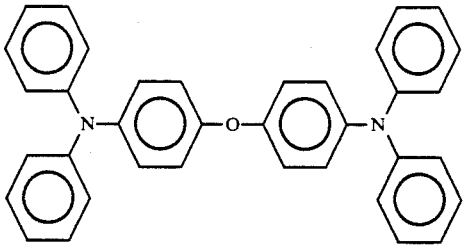

and

IV. Bis alkyl-arylamines such as:

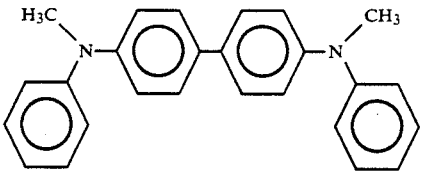

A preferred aromatic amine compound has the general formula:

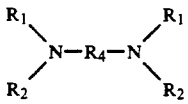

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4,4'-bis(diethylamino)-2,2'-dimethyltriphenylmethane; N,N'-bis(alkylphenyl)-(1,1'-biphenyl)4,4'-diamine wherein the alkyl is, for example, methyl, ethyl, propyl, n-butyl, etc.; N,N'-diphenyl-N,N'-bis(3'-methylphenyl)-(1,1'-biphenyl)-4,4'-diamine; and the like, dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight from about 35,000 to about 40,000, available as Lexan 145 from General Electric Company; poly(4,4'-isopropylidene-diphenylene carbonate) with a molecular weight from about 40,000 to about 45,000 available as Lexan 141 from General Electric Company; a polycarbonate resin having a molecular weight from about 50,000 to about 100,000, available as Makrolon from Farbenfabricken Bayer A.G.; a polycarbonate resin having a molecular weight from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayer photoconductor comprises a charge generating layer comprising a binder layer of photoconductive material and a contiguous hole transport layer of a polycarbonate resin material having a molecular weight of from about 20,000 to about 120,000, having dispersed therein from about 25 to about 75 percent by weight of one or more compounds having the formula:

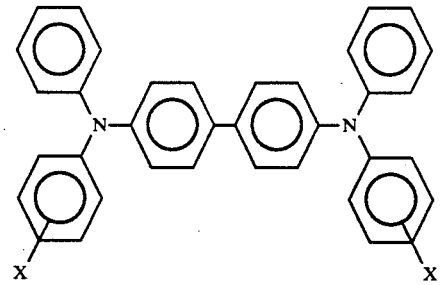

wherein X is selected from the group consisting of an alkyl group, having from 1 to about 4 carbon atoms, and chlorine, the photoconductive layer exhibiting the capability of photogeneration of holes and injection of the holes, the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

The thickness of the charge transport layer may range from about 10 micrometers to about 50 micrometers, and preferably from about 20 micrometers to about 35 micrometers. Optimum thicknesses may range from about 23 micrometers to about 31 micrometers.

If the desired surface roughness is introduced into the charge transport layer, then it may be considered to be the overcoat layer, and the separate layer 7 is not necessary. The overcoat layer 7 of the present invention may be applied to the charge transport layer of the above-described imaging member in the manner discussed above for achieving the desired surface roughness. The imaging member may be first corona treated prior to application of the overcoating solution to promote adhesion. Corona treatment involves the application of charge to a surface, such as that used to charge a photoreceptor in imaging processes.

The cleaning blade of the invention may include elastomer blades, plastic blades and the like. In a typical photoreceptor, the friction between the cleaning blade and the moving photoreceptor causes the blade edge to curl under or tuck. A certain degree of blade edge tuck is normal, and is probably necessary for cleaning. However, excessive blade tuck can lead to cleaning failures.

Blade tuck and wear may be reduced and remain uniform when cleaning is effected on the overcoat layers of the invention.

The above described imaging member may be employed in an imaging device utilizing a raster output scanner (not shown). Raster output scanners are well known in the art. Examples of raster output scanners are provided in U.S. Pat. Nos. 4,583,126 to Stoffel, 4,639,073 to Yip et al, 4,686,542 to Yip et al, 4,796,964 to Connell et al and 4,804,980 to Snelling, incorporated herein by reference.

The invention will further be illustrated in the following, non-limiting Examples, it being understood that these Examples are intended to be illustrative only and that the invention is not intended to be limited to the materials, conditions, process parameters and the like recited therein.

COMPARATIVE EXAMPLE I

A photoconductive imaging member is prepared by providing a web of titanium coated polyester (Melinex 442 available from ICI Americas Inc.) substrate having a thickness of 3 mils, and applying thereto, using a gravure applicator, a solution containing 50 grams 3-amino-propyl triethoxysilane, 15 grams acetic acid, 684.8 grams of 200 proof denatured alcohol and 200 grams heptane. This layer is then dried for 10 minutes at 135° C. in a forced air oven. The resulting blocking layer has a dry thickness of 0.05 micrometer.

An adhesive interface layer is then prepared by applying a wet coating over the blocking layer, using a gravure applicator, containing 0.5 percent by weight based on the total weight of the solution of polyester adhesive (du Pont 49,000, available from E.I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is then placed on a shaker for 10 minutes. The resulting slurry is thereafter applied to the adhesive interface with an extrusion die to form a layer having a wet thickness of about 0.5 mil. This photogenerating layer is dried at 135° C. for 5 minutes in a forced air oven to form a photogenerating layer having a dry thickness of 2.3 micrometers.

This member is then coated over with a charge transport layer. The charge transport coating solution is prepared by introducing into a carboy container in a weight ratio of N,N'-diphenyl-N,N'-bis(3-methylphenyl)-1,1'-biphenyl-4,4'-diamine, and the binder resin Makrolon 5705, a polycarbonate having a weight average molecular weight from about 50,000 to about 1,000,000, available from Farbenfabricken Bayer AG. The resulting solid mixture is dissolved in methylene chloride to provide a 15 weight percent solution thereof. This solution is then applied onto the photogenerator layer by extrusion coating to form a wet charge transport layer. The resulting photoconductive member is then dried at 135° C. in a forced air oven for 5 minutes to produce a 24 micrometers dry thickness charge transport layer.

EXAMPLE II

An overcoat solution of the present invention is prepared. Initially, 90.0 grams of 10 wt% Elvamide 8061 from du Pont in 90.0% methyl alcohol/10% N-propyl alcohol is prepared. Then, 9.0 grams of a tetrahydroxy aryl amine having the formula:

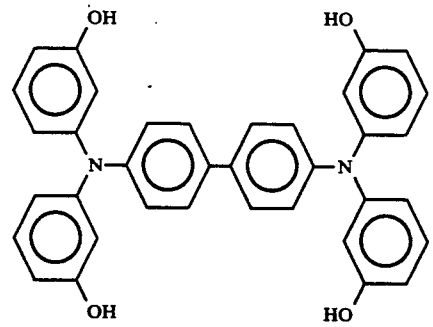

is added to the solution. To the overcoat solution is added 22.5 grams of 0.5 wt% Elvacite 2008, a polymethyl methacrylate available from du Pont, and 80/20 N-propanol-/$H_2O$. Elvacite 2008 is added to promote interfacial bonding.

The 90.0 grams of 10 wt% Elvamide/9.0 grams tetrahydroxy aryl amine gives an approximate 50/50 wt% charge transport compound/binder polymer loading. The above solution is sufficient to coat a single 16"×42" rectangular imaging area sized belt to a thickness of about 4 to about 5 micrometers. In cases where belts are to be fabricated for machine testing, lengths from a production roll are first corona treated using a standard industry technique for treating large surface area samples to promote adhesion of the overcoat.

The overcoat solution is applied directly to numerous sections of the standard imaging members described in Comparative Example I. Rough surface topologies are obtained by drying the overcoat in an open atmosphere in a clean room facility at about 65° F. to 70° F. and relative humidity of about 32 to 40%. These conditions yield an enhanced rate of solvent evaporation, and the appropriate turbulent drying conditions. Capping the overcoat during drying retards solvent evaporation and produces a smoother surface which is found not to reduce blade friction or blade edge tuck in bench fixture measurements. Following air drying and set of the overcoat surface roughness, final drying at 125° C. for about 1.0 hour is necessary to achieve optimum adhesion of the overcoat layer to the underlying transport layer.

EXAMPLE III

The overcoat solution of EXAMPLE II is applied directly, and at various roughnesses to glass disks for bench fixture testing of xerographic cleanability, blade/substrate friction evaluation and blade tuck uniformity.

Friction measurements and blade edge observations are carried out on the coated glass disk fixtures. A glass disk fixture essentially consists of three main parts:

1) A tin oxide coated glass disk, toner hopper and developer roll assembly, and power supplies for charging and bias control. Toner is electrostatically deposited directly onto the glass disk.

2) A power train to drive the disk.

3) A blade holder/blade control assembly. The angle of the blade against the glass disk can be set and monitored during operation. The blade force is adjustable by a counter weight mechanism, and the friction force is directly measured and continuously monitored. The blade/disk contact is microscopically monitored through the back side of the disk using a video camera. Waste toner is continuously removed from the cleaning zone by vacuum exhaust.

In all the disk fixture measurements, magnetic toner having a particulate additive is used. The additive component is found not to reduce blade/substrate friction in the disk fixture. The two types of magnetic toners (with and without additive) yield a characteristic coefficient of friction against an uncoated (blank) disk of about 1.0 at typical blade loadings of about 25 grams/centimeter.

Three overcoated glass disks are tested. Two glass disks having a relatively smooth overcoat clean well, but otherwise behave similarly to bare glass and the photoreceptors of the Comparative Examples. There is no reduction in blade tuck or blade/substrate friction. A portion of one of these overcoated disks has large scale (amplitude) waviness. This area does not clean and toner accumulates at the crest of the asperities.

A third disk overcoated with the appropriate roughness of the invention shows a much lower force of cleaning, a reduced blade tuck, and a much lower blade/substrate friction. Table 1 shows that the overcoated members provide good cleaning and reduced coefficient of friction compared to the uncoated glass disks. A blade force of about 7.50 grams/cm is the minimum required for good cleaning. This is about a factor of three better than the normal force required for a blade to clean toner.

TABLE 1

FRICTION MEASUREMENTS ON COATED AND UNCOATED GLASS DISKS

| OVERCOAT | | | GLASS | | |
|---|---|---|---|---|---|
| BLADE FORCE/ FRICTION FORCE | COEFFICIENT OF FRICTION | CLEANING | BLADE FORCE/ FRICTION FORCE | COEFFICIENT OF FRICTION | CLEANING |
| 7.5/4.5 | 0.60 | good | 7.5/10.0 | 1.33 | poor |
| 10.0/5.5 | 0.55 | good | 10.0/10.0 | 1.00 | poor |
| 14.5/8.0 | 0.55 | good | 14.5/12.0 | 0.83 | good |
| 15.0/9.5 | 0.63 | good | 15.0/15.0 | 1.00 | good |
| 18.75/ 11.2 | 0.60 | good | | | |
| 20.0/ 15.0 | 0.75 | good | | | |
| 25.0/15.0–20.0 | 0.60–0.80 | good | | | |

Force in grams/cm

COMPARATIVE EXAMPLE IV

The photoconductive imaging member of Comparative Example I is fabricated into a conventional belted photoreceptor having a seam. A comet verification cleaning stress target is positioned to search for and highlight comet defects.

A magnetic type toner invariably produces printable comets and leaves a ghost image in approximately 30,000 belt copies with a blade cleaner. The ghost or "burned-in" image is caused by the toner or magnetic particles impacting onto the photoreceptor in the non-image area. The difference in texture between the image and non-image areas gives the photoreceptor a ghost-like appearance.

Toner additives are invariably required to eliminate cometing and other types of photoreceptor filming. These additives can also serve as a lubricant for the blade. Therefore, an important advantage of the present invention is that toner additives are not required and lubricant-less blade cleaning may be provided.

EXAMPLE V

One overcoated belt of Example II is successfully print tested for 100,000 copies in a conventional xerographic copier machine having a photoreceptor speed of about 10 inches per second using the magnetic toner. The belt exhibits no cleaning problems throughout the test. Print quality is excellent. There is no cometing or ghosting noted. After a total of 100,000 copies on the belt, there is no apparent change in surface topology.

These results have been verified with comparably prepared belts in shorter term tests to approximately 50,000 copies.

EXAMPLE VI

Experiments are run using the charge transport coating solution of Comparative Example I to form an overcoat layer. It is noted that this coating solution does not yield turbulent drying patterns necessary to optimize the surface roughness to enhance cleaning.

EXAMPLE VII

Frictional tests with xerographic toner on frosted and smooth glass are conducted. The coefficient of friction between the glass and blade with this toner is measured. The frosted glass surface is found to provide a coefficient of friction lower than that for smooth glass. The frosted glass surface has a coefficient of friction of approximately 0.6 at a normal cleaning force of about 25 g/cm. In contrast, smooth glass has a coefficient of friction of about 1.0 at a cleaning force of about 25 g/cm. In addition, the blade tuck on the frosted surface is significantly less than that on the smooth surface. It is apparent that a rough surface has a remarkable effect on reducing friction and blade tuck.

COMPARATIVE EXAMPLE VIII

A photoconductive imaging member is prepared as in Comparative Example I. Examination of this uncoated sample under a sodium light source shows creation of a plywood pattern.

EXAMPLE IX

A primer solution is prepared containing 0.1 wt.% Elvicite 2008 (duPont) in 90/10 isopropyl alcohol/water. The primer solution is applied onto a 30"×15" section of the photoreceptor of Example VIII using a #3 Mayer rod and air dried. Lab coating conditions are 70° F., 45% relative humidity. The primer layer is used to increase adhesion of the subsequently applied overcoat layer to the photoreceptor surface.

An overcoat solution is then prepared containing 50.0 g of 10% Elvamide 806 1 (duPont) in 90/10 methanol/propanol, 10.0 g of N-propanol, and 5.0g of a m-dihydroxy aryl amine having the formula:

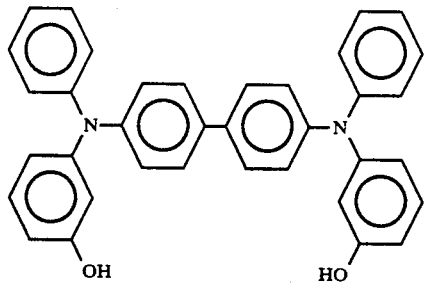

The overcoat solution is applied on the primer layer using a #34 Mayer rod and air dried for 30 minutes, and then placed in 125° C. air for one hour to dry. The resulting overcoat layer thickness is about 4.0 μm. The surface roughness ranged from about 0.1 micrometer to about 0.3 micrometer in the vertical direction, and from about 25.0 micrometers to about 200.0 micrometers in the lateral direction.

Examination of the coated sample of Example II under a sodium light source shows complete elimination of the plywood pattern.

COMPARATIVE EXAMPLE X

A photoconductive imaging member is prepared as in Comparative Example I, except that the photogeneratinq layer is replaced with an experimental material exhibiting a greater susceptibility to plywood at longer wavelengths of light.

Examination of this uncoated sample under a sodium light source shows creation of a plywood pattern.

EXAMPLE XI

The photoconductive imaging member of Comparative Example X is coated with the primer and overcoat solutions as described in Example IX, resulting in an overcoat layer of 4.0 μm. The surface roughness ranged from about 0.1 micrometer to about 0.3 micrometer in the vertical direction, and from about 25.0 micrometers to about 200.0 micrometers in the lateral direction.

Examination of this coated sample under a sodium light source shows complete elimination of the plywood pattern.

EXAMPLE XII

The samples of Comparative Example X and Example XI are fabricated into seamed photoreceptor belts. Prints are made with an infrared (780 nm) laser diode Raster Output Scanner to test for plywood under machine conditions. Plywood is present on the print made by the uncoated sample of Comparative Example X, whereas the print made by the coated sample of Example XI eliminates plywood so that it is not distinguishable from other solid area defects.

EXAMPLE XIII

A photoreceptor belt is prepared from the sample of Example IX. The photoreceptor belt is print tested for 100,000 cycles. Examination after 100,000 cycles shows that the rough surface due to the overcoat is not eroded.

While the invention has been described with reference to particular preferred embodiments, the invention is not limited to the specific Examples given, and other embodiments and modifications can be made by those skilled in the art without departing from the spirit and scope of the invention.

What is claimed is:

1. An imaging member comprising at least one photosensitive layer and an overcoat layer formed from a solution having a surface roughness defined by asperities formed by circulation patterns formed in the layer during drying, wherein said surface roughness comprises a lateral roughness of between about 1 micrometer and about 200 micrometers, and a vertical roughness less than or equal to about 1 micrometer.

2. The imaging member of claim 1, wherein said surface roughness comprises a lateral roughness of about 50 micrometers to about 150 micrometers and a vertical roughness of about 0.1 micrometer to about 0.3 micrometer.

3. The imaging member of claim 2, wherein said surface roughness is accompanied by a fine scale roughness comprised of a lateral roughness of about 1 micrometer to about 10 micrometers and a vertical roughness of about 0.2 micrometer to about 0.3 micrometer.

4. The imaging member of claim 1, wherein said surface roughness comprises a lateral roughness of about 5.0 micrometers to about 100.0 micrometers and a vertical roughness of about 0.2 micrometer to about 0.5 micrometer.

5. The imaging member of claim 1, wherein said overcoat layer comprises a charge transport compound which is a triaryl amine having hydroxy functionalities.

6. The imaging member of claim 1, wherein said overcoat layer comprises silicone.

7. The imaging member of claim 1, wherein said overcoat layer comprises an electron donor compound.

8. The imaging member of claim 1, comprising a supporting substrate, a conductive layer, a blocking layer, an adhesive layer, a charge generating layer, a charge transport layer, and said overcoat layer.

9. The imaging member of claim 1, wherein said overcoat layer comprises a charge transport compound and a binder which are bonded through hydrogen bonds.

10. An imaging member comprising a non-continuous overcoat layer, formed from a polymer solution, having a surface roughness defined by hemispheric dots of the layer formed during drying.

11. The imaging member of claim 10, wherein the surface roughness is comprised of a lateral roughness of about 5.0 to about 10.0 micrometers and a vertical roughness of about 0.2 to about 0.5 micrometer.

12. The imaging member of claim 10, wherein the dots are present in a concentration of about 10,000 to about 40,000 dots per square millimeter.

13. An imaging system, comprising:

an imaging member comprising an overcoat layer having a surface roughness defined by a vertical roughness less than or equal to about 1 micrometer and a lateral roughness of about 1 to about 200 micrometers; and a blade contacting said overcoat layer.

14. The system of claim 13, further comprising a raster output scanner.

15. The system of claim 13, wherein the vertical roughness is about 0.1 micrometer to about 0.3 micrometer and the lateral roughness is about 50 micrometers to about micrometers.

16. The system of claim 13, wherein the vertical roughness is about 0.2 micrometer to about 0.5 micrometer and the lateral roughness is about 5.0 micrometers to about 100.0 micrometers.

17. An imaging system, comprising:

an imaging member comprising an overcoat layer having a surface roughness defined by a vertical roughness of about 0.2 to about 0.5 micrometer and a lateral roughness of about 5.0 to about 100.0 micrometers; and a raster output scanner.

18. A method for fabricating an overcoat layer for an imaging member, comprising:

applying a coating solution to a surface of said imaging member to form an overcoat film; and drying the overcoat film under such conditions that circulation patterns are formed in and become frozen into a surface of the result in dry overcoat layer.

19. The method of claim 18, wherein said drying is carried out at about 65°–70° F. and relative humidity of about 30 to about 40%.

20. The method of claim 18, wherein said drying is performed such that a surface roughness of the overcoat layer comprises a lateral roughness of about 1 micrometer to about 200 micrometers and a vertical roughness less than about 1.0 micrometer.

21. The method of claim 18, wherein said drying is performed such that a surface roughness of the overcoat layer comprises a lateral roughness of about 50 micrometers to about 150 micrometers and a vertical roughness of about 0.1 micrometer to about 0.3 micrometer.

22. The method of claim 21, wherein said surface roughness is accompanied by a fine scale roughness comprised of a lateral roughness of about 1 micrometer to about 10 micrometers and a vertical roughness of about 0.2 micrometer to about 0.3 micrometer.

23. The method of claim 18, wherein said drying is performed such that a surface roughness of the overcoat layer comprises a lateral roughness of about 5.0 to about 100.0 micrometers and a vertical roughness of about 0.2 to about 0.5 micrometer.

24. The method of claim 18, wherein said coating solution comprises a film forming binder, a charge transport compound, and a solvent.

25. The method of claim 24, wherein said charge transport compound is a triaryl amine.

26. A method of electrophotographic imaging, comprising:

scanning a photoreceptor having a textured surface with a raster output scanner to form a latent image on the photoreceptor, said textured surface acting as an anti-reflection layer of light from the raster output scanner;

applying toner particles to the latent image to develop the image;

transferring the developed image to a support member; and fixing the transferred image on the support member;

wherein the textured surface has a lateral surface roughness of about 5.0 to about 100.0 micrometers, and a vertical roughness of about 0.2 to about 0.5 micrometer.

27. The method of claim 26, wherein said textured surface comprises a charge transport compound which is a triaryl amine having hydroxy functionalities.

28. The method of claim 26, wherein said textured surface is non-continuous.

29. The method of claim 26, wherein said textured surface is obtained by circulation patterns formed upon drying a solution used to form the textured surface.

* * * * *